United States Patent [19]

Brinkers

[11] Patent Number: 4,519,497

[45] Date of Patent: May 28, 1985

[54] CONTAINER, IN PARTICULAR FOR A CODICIL OR SIMILAR PERSONAL DOCUMENT

[76] Inventor: Edith L. C. Brinkers, Leidsegracht 2, Amsterdam, Netherlands

[21] Appl. No.: 564,389

[22] Filed: Dec. 22, 1983

[51] Int. Cl.[3] ..... A45C 11/00; B65D 83/00

[52] U.S. Cl. ..... 206/37; 206/232; 206/389; 220/4 E; 220/4 B; 242/55.53

[58] Field of Search ..... 206/37, 232, 204, 389, 206/409, 804; 242/55.53; 220/4 E, 4 B

[56] References Cited

U.S. PATENT DOCUMENTS

| | | | |
|---|---|---|---|
| 1,097,385 | 5/1914 | Barns | 206/409 |
| 1,573,663 | 2/1926 | Warren | 206/232 |
| 1,841,266 | 1/1932 | Jones | 206/232 |
| 1,856,619 | 5/1932 | Carsey | 206/389 |
| 3,306,266 | 2/1967 | McCunner | 206/37 |
| 3,567,085 | 3/1971 | Flores | 206/204 |
| 3,647,059 | 3/1972 | Humphreys | 242/55.53 |
| 4,129,228 | 12/1978 | Stoneback | 206/37 |
| 4,333,562 | 6/1982 | Todd | 206/37 |
| 4,393,974 | 7/1983 | Levesque | 206/37 |
| 4,420,076 | 12/1983 | Beveridge et al. | 206/37 |

*Primary Examiner*—William T. Dixson, Jr.

*Attorney, Agent, or Firm*—Schwartz, Jeffery, Schwaab, Mack, Blumenthal & Koch

[57] ABSTRACT

A container, in particular for a codicil or similar personal document, which the relevant individual should carry with him substantially at all times, said container comprising a first, substantially cylindrical inner sleeve closed at one end and a second substantially cylindrical outer sleeve closed at one end, which sleeves can be screwed one over the other such that a closed space is formed within the inner sleeve into which a reel can be positioned carrying the codicil while at least one of the sleeves is provided with means to which a chain, string or the like is attached.

1 Claim, 3 Drawing Figures

CONTAINER, IN PARTICULAR FOR A CODICIL OR SIMILAR PERSONAL DOCUMENT

Figure 1:
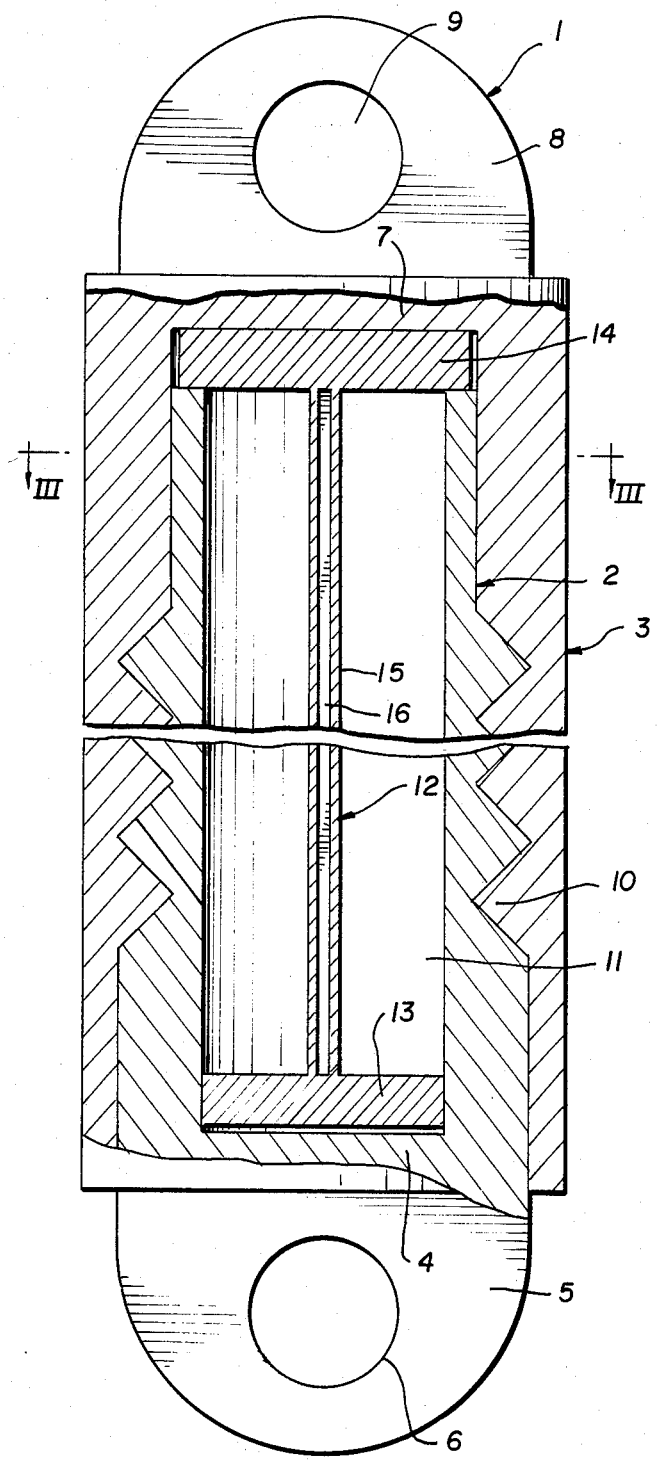

The invention relates to a container, in particular for a codicil or similar personal document, which the relevant individual should carry with him substantially at all times.

Such containers may have the shape of plastic foils between which the codicil is positioned, and which foils are sealed to each other along the edges. Though the codicil is well protected against moisture in this manner, it is a disadvantage, that no alterations can be made in the codicil without destruction of the container.

The placement of data on a metal plate carries with it also the disadvantage, that is is very difficult to make alterations in the data.

The invention has as an object to provide a container, which does not show these disadvantages.

The container according to the invention comprises to that end a first, substantially cylindrical inner sleeve, closed at one end, provided over at least part of its length with an external screw thread and a second substantially cylindrical outer sleeve, closed at one end, provided over at least part of its length with an internal screw thread and which can be screwed thereon from the open end of the inner sleeve such that a closed space can be formed within the two sleeves into which the codicil can be positioned, while at least one of the sleeves is provided with means to which a chain, string or similar may be attached.

In this manner a container of small dimensions can be obtained, in which the codicil can be positioned in a rolled condition.

In order to facilitate inserting and removing of the codicil, provisions can be made in accordance with the invention to wrap the codicil on a reel, which can be inserted into the inner sleeve and which is carried out in such a manner, that always a part thereof protrudes outside the inner sleeve.

It can always be achieved, that the reel can easily be withdrawn from the inner sleeve, when the outer sleeve has been screwed off the inner sleeve, for example by making the reel slightly longer then the length of the cylindrical hollow space into which it is inserted.

Though it might be possible to make the fitting screw threads very accurately, so that no moisture can penetrate along them, this would require a very accurate and consequently expensive manufacture, with at the same time the risk, that the sleeves might no longer be screwed from or into each other after a very minor deformation of one or both of the sleeves.

In order to ascertain that no moisture can penetrate into the container either with a less accurate realization of the screw thread, provisions can be made that the reel is manufactured of a somewhat flexible material, such as for example a plastic and that the end of the reel protruding outside the inner sleeve is formed by a disk, which is tightly clamped between the end rim of the inner sleeve and the closed end of the outer sleeve.

Factually a part of the reel forms a sealing ring so that moisture possibly entering along the screw thread can not reach the codicil present in the container.

Figure 2:
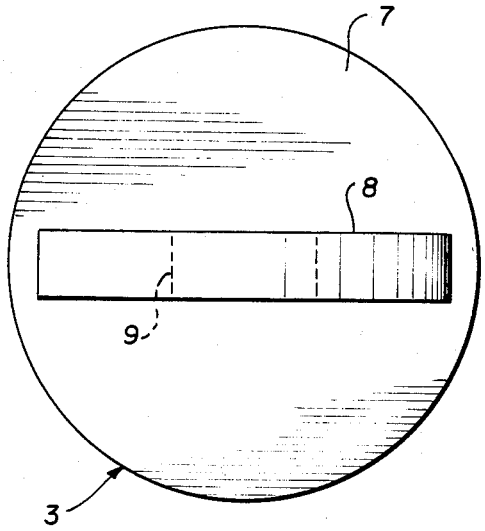
Figure 3:
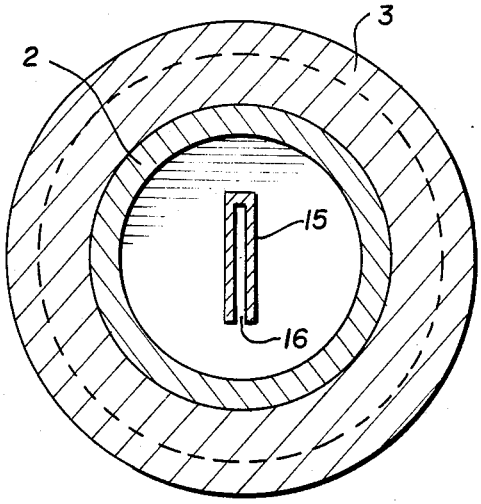

The invention is further elucidated by means of an embodiment shown in the drawing, wherein:

FIG. 1 shows a front view and a partial longitudinal section of a container according to the invention, FIG. 2 presents a partial end view of the container according to FIG. 1; and FIG. 3 shows a partial cross-section along the line III—III of FIG. 1.

The container 1, shown in the drawing, comprises an inner sleeve 2 and an outer sleeve 3. The inner sleeve 2 is closed off at one end by a wall 4, which is provided with a lip 5, in which an opening 6 is present. In a similar manner the outer sleeve 3 is provided with a closing wall 7, supporting a lip 8, wherein an opening 9 is present.

The sleeve 3 can be shoved over the sleeve 2 and be screwed down thereon by means of the screw thread 10. In a hollow space 11 of the sleeve 2 a reel 12 can be positioned, which consists of a disklike part 13, a disklike part 14 and a connecting part 15, provided with a slot 16, extending thereinbetween. Reel 12 is made of a somewhat flexible material, such as, for example, plastic.

It will be clear that when taking container 1 in use, a rim of the codicil to be put away is placed in the slot 16 of the reel 12, whereafter the codicil is wrapped on the connecting part 15. Subsequently the disk 13 of the reel 12 is inserted into the inner sleeve 2 until the disk 14 of the reel 12 is located against the end rim of the inner sleeve, whereafter the outer sleeve 3 is shoved thereover and is screwed tight onto the inner sleeve by means of screw thread 10, so that disk 14 of the reel 12 is tightly pressed between the end rim of the inner sleeve 2 and the closing wall 7 of the outer sleeve 3.

By means of the openings 6 and 9 in the lips 5 and 8 the container can be connected to a string or chain, so that the container may be worn around the neck of an individual.

What is claimed is:

1. A container for a personal document, which the relevant individual should carry substantially at all times, said container comprising a first, substantially cylindrical inner sleeve, open at one end and closed at one end, provided over at least part of its length with an external screw thread and a second substantially cylindrical outer sleeve open at one end and closed at one end, provided over at least part of its length with an internal screw thread and which can be screwed thereon from the open end of the inner sleeve such that a closed space can be formed within the two sleeves into which the personal document can be positioned, while at least one of the sleeves is provided with means to which a chain, string or the like may be attached, and further including a reel on which the personal document can be wrapped, the reel being sized to be shoved into the inner sleeve with a part thereof always protruding from the inner sleeve, and wherein the end of the reel extending from the inner sleeve includes a disk which is formed from a flexible material, said disk having a diameter greater than the inner diameter of said inner sleeve and less than the inner diameter of said outer sleeve, said disk resting on the open end of said inner sleeve and being clamped between the open end of the inner sleeve and the closed off end of the outer sleeve when said outer sleeve is screwed onto said inner sleeve.

* * * * *